United States Patent [19]

Willits

[11] Patent Number: 4,625,705

[45] Date of Patent: Dec. 2, 1986

[54] BOWSTRING RELEASE APPARATUS

[76] Inventor: William P. Willits, 251 Lockwood St., Saginaw, Mich. 48602

[21] Appl. No.: 479,484

[22] Filed: Mar. 28, 1983

[51] Int. Cl.[4] ..... F41B 5/00

[52] U.S. Cl. ..... 124/35 A; 124/90

[58] Field of Search ..... 124/90, 86, 41 A, 35 A, 124/80, 23 R, 24 R, 35 R, 92; 132/46 R, 48 R, 48 A; 24/298

[56] References Cited

U.S. PATENT DOCUMENTS

| | | | |
|---|---|---|---|
| De. 237,489 | 11/1975 | Wigley | 124/90 X |
| 1,243,337 | 10/1917 | O'Connell | 124/90 X |
| 3,010,446 | 11/1961 | Franstello | 124/86 |
| 3,028,851 | 4/1962 | Drake | 124/35 R |
| 3,800,774 | 4/1974 | Troncoso, Jr. | 124/35 A |
| 3,804,454 | 4/1974 | Simmons | 24/298 X |
| 3,845,752 | 11/1974 | Barner | 124/35 A |
| 3,847,133 | 11/1974 | Awiszus | 124/35 A X |
| 3,886,924 | 6/1975 | Chesnick | 124/35 A X |
| 3,937,206 | 2/1976 | Wilson | 124/35 A |
| 4,009,703 | 3/1977 | Cunningham | 124/35 A |
| 4,086,904 | 5/1978 | Suski et al. | 124/90 |
| 4,116,194 | 9/1978 | Topel | 124/87 |
| 4,156,417 | 5/1979 | Fletcher | 124/35 A |
| 4,232,649 | 11/1980 | Allen et al. | 124/35 A |
| 4,282,851 | 8/1981 | Lyons | 124/35 A |
| 4,316,443 | 2/1982 | Giacomo | 124/35 A |

*Primary Examiner*—William H. Grieb

*Attorney, Agent, or Firm*—John J. Swartz

[57] ABSTRACT

Apparatus for aiding the drawing and releasing of a bowstring, including a flexible endless cord having a pair of end loops which snugly receive the bowstring, and an intermediate draw loop of predetermined size for snugly receiving and holding a bowstring draw pin. Expansible and contractible sleeves are mounted on the cord between the end loops and the draw loop, permitting portions of the endless cord to relatively move and expand the size of the draw loop to a greater predetermined size when the bow is drawn, and thus permit the escape of the draw pin. One aspect of the invention includes hand held bowstring draw mechanism pivotally mounting the draw pin for movement between a bowstring draw position and a bowstring release position and mechanism for selectively holding the draw pin in the draw position.

31 Claims, 9 Drawing Figures

BOWSTRING RELEASE APPARATUS

BACKGROUND OF THE INVENTION

1. Field of the Invention

This invention relates to apparatus for aiding the drawing and releasing of a bowstring and, more particularly, to a flexible, string-mounted release aid. One aspect of the invention includes a hand-held, bowstring draw member having a bowstring draw pin with an enlarged head for detachably coupling to the release aid.

2. Description of Prior Art and Objects of Invention

Traditionally, an archer propelled an arrow by holding a curved bow in one hand, drawing a taut, bow-mounted bowstring relative to the bow with the fingers of the other hand, and then suddenly releasing the bowstring to propel an arrow which, at the rearward end thereof, had a rearwardly opening recess receiving a mid-portion of the bowstring.

Thereafter, a variety of different mechanical bowstring release aid devices have been provided in attempts to increase the uniformity and consistency with which the archer released the drawn bowstring. Although some of these devices have aided archers in improving marksmanship, they also have attendant disadvantages. Accordingly, it is the object of the present invention to provide new and novel bowstring release apparatus for improving an archer's marksmanship.

Hand-held, trigger-activated, bowstring draw and release mechanism has been provided for drawing the bowstring and releasing same to improve accuracy, aim and trajectory of an arrow, such as that disclosed in U.S. Pat. No. 4,282,851 granted to Leon W. Lyons on Aug. 11, 1981, and U.S. Pat. No. Des. 237,489 granted to Marston E. F. Wigley on Nov. 4, 1975.

Other bowstring draw and release devices, including a bowstring draw cord, defining a bowstring receiving loop, have been provided to improve release and prevent misalignment of the bowstring and the arrow with the target, such as that disclosed in U.S. Pat. No. 3,937,206 granted to Hugh R. Wilson on Feb. 10, 1976; U.S. Pat. No. 3,845,752 granted to Roland K. Barner on Nov. 5, 1974; U.S. Pat. No. 4,156,417 granted to James D. Fletcher on May 29, 1979; and U.S. Pat. No. 3,800,774 granted to Fernando Troncoso, Jr. on Apr. 2, 1974.

The aforedescribed prior art devices do not include any portion which remains coupled to the bowstring upon release of the bowstring and, thus, the string-engaging member, upon release, will abrade the string and shorten string life. Accordingly, it is an object of the present invention to provide new and novel bowstring release apparatus which will increase string life.

Another object of the present invention is to provide a new and novel string-mounted release aid including a flexible cord which remains coupled to the bowstring upon release of the bowstring.

The prior art release aids, such as that disclosed in the aforementioned U.S. Pat. Nos. 3,800,774; 3,845,752; 3,937,206; 4,156,417; and U.S. Pat. No. 4,316,443, will not unassistedly remain in shooting position on the bowstring when the bowstring is not drawn. With such prior art release aids, the archer must, prior to shooting, insure that the prior art device is properly positioned along the length of the bowstring. The apparatus constructed according to the present invention includes a flexible loop of material which will unassistedly remain in a pre-set position on the bowstring but which can, under a predetermined force, be adjustably positioned along the length of the bowstring. Accordingly, the pre-shooting preparation time is minimized.

Therefore, it is another object of the present invention to provide new and novel bowstring release aid apparatus which will minimize pre-shooting preparation time.

Animals being hunted by an archer are sometimes frightened by relatively low level noise. When a bowstring is released, it will normally vibrate and generate a noise prior to coming to rest. To eliminate such string noise, game hunting archers frequently employ vibration dampening devices which are attached to the bowstring. Such devices, of course, represent another item of expense for the archer and another device which must be installed and maintained. Accordingly, it is yet another object of the present invention to provide bowstring release apparatus which will function as a bowstring vibration dampener.

U.S. Pat. No. 3,010,446 granted to A. A. Frantello on Nov. 28, 1961, discloses string-mounted release aid apparatus for holding and releasing a bowstring and arrow, including a knob having substantial mass. A release aid which remains attached to a bowstring should be relatively light-weight so as not to unduly restrict the string speed. Accordingly, it is yet another object of the present invention to provide a string-mounted release aid which will remain coupled to the bowstring upon release of the bowstring to function as a vibration dampener but which will not unduly restrict string speed.

U.S. Pat. No. 4,086,904 granted to Michael D. Suski on May 2, 1978 and U.S. Pat. No. 3,847,133 granted to Waldemar K. Awiszus on Nov. 12, 1974 each disclose a string-mounted release aid including a rigid elongated body Upon release of the bowstring and arrow, the string sometimes strikes the archer's arm which holds the bow. Any object which is attached to the string will likewisely strike the archer's forearm. It is important that a release aid be constructed so as to minimize potential injury to an archer. Accordingly, it is still another object of the present invention to provide a string-mounted release aid which will dampen string vibration without unduly restricting string speed while minimizing injury to the archer in the event that the release aid strikes a part of the archer's body.

Archers also frequently employ a string-mounted peep sight to increase their sighting accuracy. As the bowstring is drawn, the string, which is formed from a plurality of twisted strands, and the string-mounted peep sight will normally rotate about the longitudinal axis of the string. Archers have heretofore mounted an elastic band between the bow and the bowstring, such as that disclosed in U.S. Pat. No. 4,116,194 granted to Kenneth D. Topel on Sept. 26, 1978, to exert a force on the body of the peepsight to align the peepsight when the bow is drawn. Such apparatus represents another expense to the archer and another device which must be installed and maintained. Another device has been disclosed in U.S. Pat. No. 3,886,924 granted to John C. Chesnick on June 3, 1975 for preventing bowstring twisting and to stabilize the peep sight, but includes an additional alignment guide mounted on the bowstring. Accordingly, it is a further object of the present invention to provide a new and novel string-mounted flexible release aid which will uniformly, consistently properly align and stabilize a bowstring mounted peep sight.

It is another object of the present invention to provide flexible release aid apparatus of the type described, which is adapted to be adjustably mounted and positioned in any selected one of a plurality of different pre-set longitudinally spaced positions.

A still further object of the present invention is to provide a bowstring release aid including a flaccid member which is tautly clamped to the bowstring to control relative rotation of the bowstring and the release aid, while force is exerted on the release aid to draw the bowstring.

Another type of prior art release aid apparatus includes a hand-held handle having a pivotal, string-engaging pin and a trigger-actuated mechanism which releases the pin for movement between a latched string-engaging position and a release position to permit escape of the drawn string. The prior art pin is of such construction that it will not, unassistedly, remain in proper position along the length of the bowstring for quick shooting. Apparatus constructed according to the present invention includes a hand-held trigger device having a pivotal pin provided with an enlarged head which is releasably held on the bowstring by a string-mounted flexible cord. Accordingly, it is another object of the present invention to provide hand-held release aid apparatus of the type described constructed so as to unassistedly remain coupled to the bowstring in a predetermined pre-draw position for proper bowstring draw.

It is yet another object of the present invention to provide mechanical hand-held, trigger-actuated bowstring draw apparatus having a bowstring draw pin including an enlarged diameter terminal head.

It is another object of the present invention to provide new and novel bowstring release apparatus for releasably coupling a bowstring draw pin to a bowstring, including a flexible loop adapted to be mounted on a bowstring.

Another object of the present invention is to provide a new and novel bowstring-mounted release aid including a flaccid loop member defining an expansible and contractible draw pin receiving eyelet.

It is yet another object of the present invention to provide a new and novel release aid including a loop member adapted to be mounted on a bowstring and including a draw pin receiving eyelet of predetermined size expansible to a greater predetermined, draw pin releasing size when the bowstring is drawn.

It is another object of the present invention to provide a new and novel bowstring-mounted release aid including a flexible cord forming a draw pin receiving eyelet.

Yet another object of the present invention is to provide a new and novel release aid of the type described, including a flexible cord, having bowstring receiving portions which, when the bowstring is not drawn, can be adjustably positioned along the length of the bowstring to tune the bow, but which tightly clamps to the bowstring to prevent relative rotation of the bowstring and the release aid when the bowstring is drawn.

It is another object of the present invention to provide a new and novel release aid of the type described, including an endless length of flexible cord comprising a pair of lines coupled at opposite ends by a pair of integral bowstring receiving loops and further including central line portions, one of which is laterally spaced relative to the other to provide a draw loop for receiving a bowstring draw member.

A further object of the present invention is to provide release aid apparatus to provide bowstring release apparatus of the type described, including an endless flexible cord having end loop portions for mounting on a bowstring, central draw pin receiving loop portions, and a pair of expansible and contractible sleeves mounted on the flexible cord between the end loop portions and the central pin-receiving portions to permit the central draw pin receiving loop portions to move relative to each other between a contracted size when the string is not drawn and an expanded size when the string is drawn.

Other objects and advantages of the present invention will become apparent to those of ordinary skill in the art as the description thereof proceeds.

SUMMARY OF THE INVENTION

Apparatus for aiding the drawing, holding and releasing of a bow-mounted bowstring, comprising a flexible line defining a central draw pin receiving aperture for receiving a draw pin, expansible and contractible members mounted on the line for normally maintaining the flexible line in such position as to provide a draw pin aperture of a predetermined size but permitting relative movement of portions of the line to expand the draw pin receiving aperture to a greater predetermined size and permit escape of the draw pin, the flexible line including end loop portions for mounting on a bowstring.

BRIEF DESCRIPTION OF THE DRAWINGS

The invention may be more readily understood by referring to the accompanying drawings, in which.

DESCRIPTION OF THE PREFERRED EMBODIMENT

Figure 2:
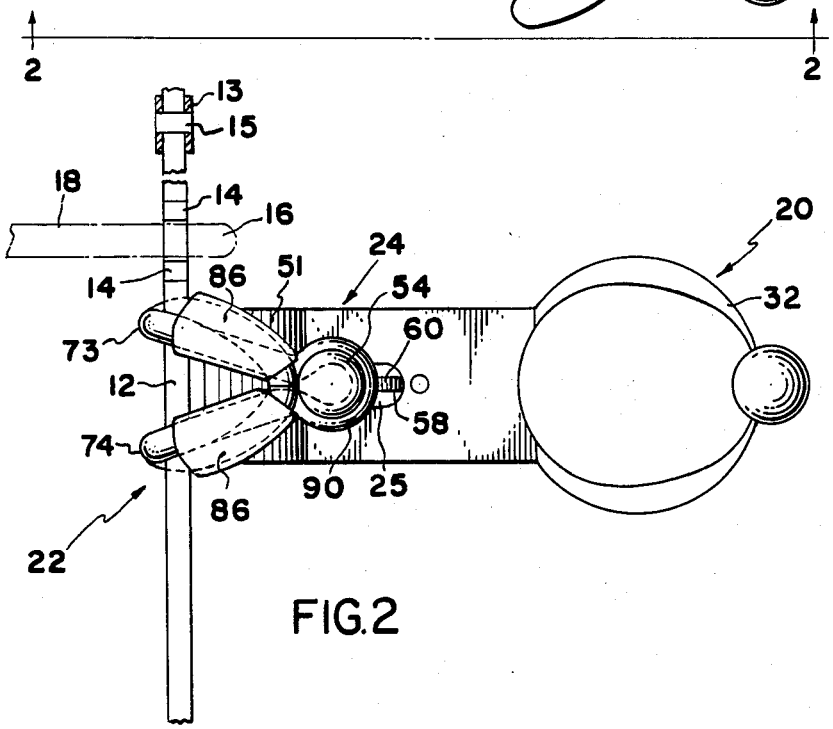
FIG. 2 is a side elevational view, taken along the line 2—2 of FIG. 1, illustrating the bowstring release apparatus constructed according to the present invention mounted on a bowstring when the bowstring is at rest and prior to draw.
Figure 9:
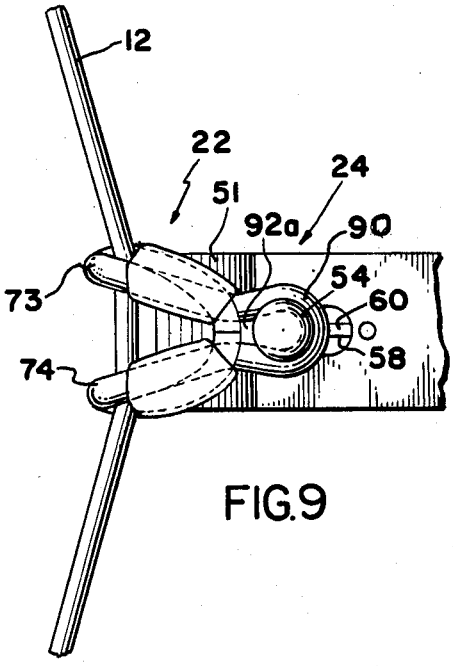
FIG. 9 is a side elevational view, similar to FIG. 2, illustrating the release aid in a bowstring drawn position.

Apparatus constructed according to the present invention, generally designated 10, is particularly adapted for use in drawing a bowstring 12, which is mounted on a conventional bow, schematically designated 17, relative to the bow, from a rest position, illustrated in FIG. 2, in which the bowstring 12 is linear, to a drawn position, illustrated in FIG. 9, in which the bowstring 12 is nonlinear. A pair of arrow-receiving nocks 14 may be clamped to the bowstring 12 in the usual fashion and receive the rearwardly opening end 16 of an arrow 18. A peep sight, generally designated 13 and including a sighting bore 15, is mounted on the bowstring 12 between the upper nock 14 and the top of the bowstring. The peep sight 13 may be of any conventional construction, and may be constructed as in the peepsight illustrated in U.S. Pat. No. 4,116,194, which is incorporated herein by reference.

The release apparatus 10, constructed according to the present invention, includes a hand-held, trigger-actuated mechanism, generally designated 20, and a bowstring-mounted, flexible release aid, generally designated 22.

The hand-held, trigger-actuated release mechanism 20 includes a hollow block housing, generally designated 24, having an internal passage or chamber 25 receiving an internal sear block 26 which is pivotally mounted on the housing 24 via a pivot pin 28. The sear block 26 is normally maintained in the position illustrated in solid lines in FIG. 1 via an internally disposed, housing mounted, coil spring 30.

A handle, generally designated 32, with finger grips 34, is fixed to the housing 24 so that the trigger-acuated mechanism 20 may be hand-held. The handle 32 includes an internal bore 36 which tightly receives the hollow block housing 24.

A trigger, generally designated 38, is provided for swinging the sear block 26 about pivot pin 28 and includes a leg 27 disposed in the passage 25 and pivotally mounted on the housing 24 via a pivot pin 40. The leg 27 includes an inner end portion 41 for engaging the outer end 42 of the sear block 26 when the trigger 38 is swung in the direction of arrow 44. The trigger 38 includes an offset leg 43 adapted to be finger-actuated by the archer in a counterclockwise direction, represented by the arrow 44, from the rest position illustrated in solid lines to the release position to drive the sear block 26 clockwisely in the direction of the arrow 46 against the biasing force of coil spring 30.

Figure 1:
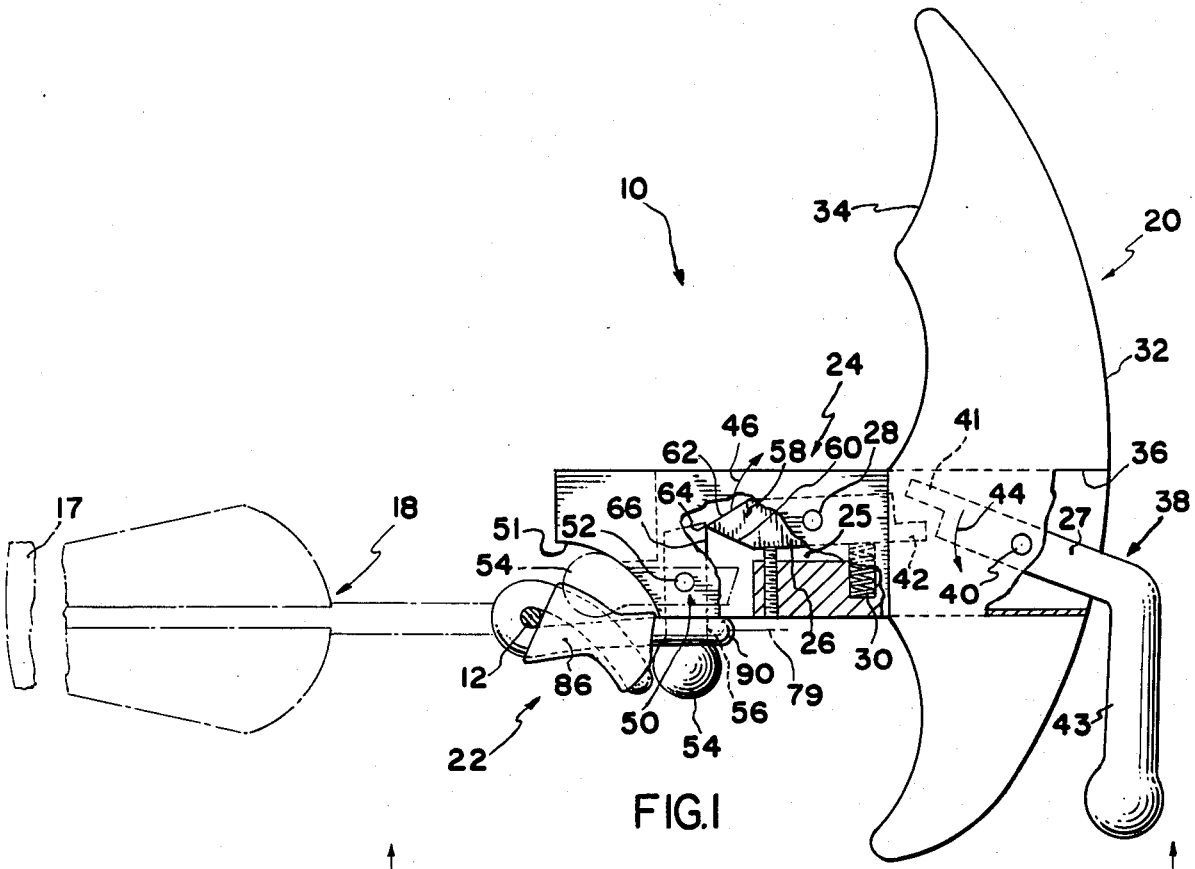
FIG. 1 is a top plan elevational view of apparatus constructed according to the present invention mounted on a bow-mounted bowstring in a rest position, part of the trigger mechanism housing being broken away to more clearly illustrate the internal portions thereof.

A bowstring draw pin, generally designated 50, which, in the draw position illustrated in solid lines in FIG. 1, projects outwardly beyond the housing 24, is pivotally mounted on the housing 24 via a pivot pin 52 for movement between the position illustrated in solid lines in FIG. 1 to the bowstring release position illustrated in chain lines in FIG. 1.

The draw pin 50 constructed according to the present invention includes a uniform reduced diameter neck 56 and an enlarged terminal head 54 for a purpose to become more apparent hereinafter. The forward portion of the block housing 24 is laterally relieved along one side thereof at 51, to receive the enlarged terminal head 54 when the draw pin 50 is in the release position illustrated in chain lines (FIG. 1). The sear block 26, constructed according to the present invention, includes a forward portion 58 having forwardly converging surfaces 60 and 62 which converge to a line contact edge 64 that engages the rearward internal surface 66 of the draw pin 50 to releasably hold the draw pin 50 in the bowstring draw position shown in solid lines in FIG. 1.

Figure 3:
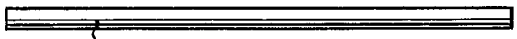
FIGS. 3–8 illustrate a bowstring release aid, constructed according to the present invention, in successive stages of assembly.

The flexible release aid member 22 includes an endless flexible or flaccid line 70 such as a rope or parachute cord comprising nylon or polypropylene material. The endless flaccid line is formed from a initial length **70*a* (FIG. 3) having distal ends which are welded or otherwise suitably secured together at 70*b* (FIG. 4) to form the endless line, band or loop 70. The endless line 70 is collapsed on itself to provide a pair of adjacent line sections 71 and 72, lying in planes 65 and 67 respectively, coupled together at opposite ends by a pair of bowstring receiving end loops 73 and 74 having bowstring receiving apertures or loopholes 75 and 76 respectively for receiving the bowstring 12. The line sections 71 and 72 include central line portions 78 and 80 integrally coupled to the end loops 73 and 74 via intermediate line portions 82 and 84** respectively.

Figure 6:
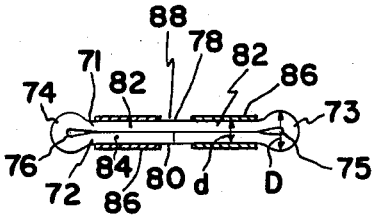

The intermediate line portions 82, 84 are snugly received by a pair of expansible and contractible sleeves 86 which are longitudinally spaced apart by a gap 88 (FIG. 6). The sleeves 86, as illustrated, have an internal diameter d which is less than the outside diameter D of the end loops 73, 74. The sleeves 86 may suitably comprise yieldable, molded neoprene or polyurethane tubing. The sleeves 86 will expand in diameter from the positions illustrated in FIGS. 1, 2 and 8 to expanded positions illustrated in FIG. 9 when bowstring draw force is exerted on the release aid 22.

Figure 7:
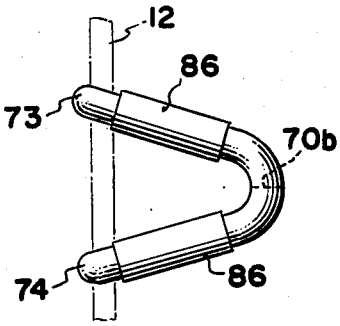
Figure 8:
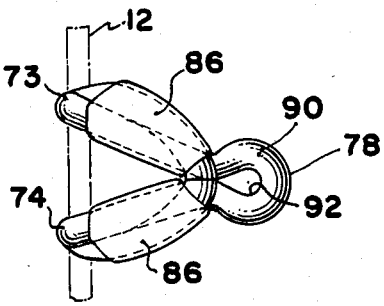

The central line portion 78 of line 71 is then displaced from the position illustrated in FIGS. 6 and 7 to a position underlying the central line portion 80 of line 72 and thence moved laterally rearwardly outwardly relative to the central line portion 80 to the position illustrated in FIG. 8, to provide a draw pin receiving loop or eyelet 90 defining a draw pin receiving recess 92 of a normal predetermined size and cross-sectional area. It should be noted that the cross-sectional area of the draw pin head 54 is greater than the cross-sectional area of the normal draw pin receiving loophole 92.

The end loops 73 and 74, when mounted on the bowstring 12, lie in planes which are generally perpendicular to the plane 79 of the draw loop or eyelet 90.

THE OPERATION

Figure 4:
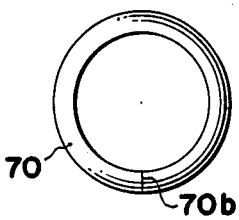
Figure 5:
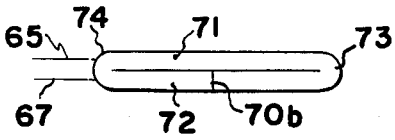

The release aid member 22 is formed by welding together, at **70*b*, the opposite terminal ends of a length of flexible cord 70*a* (FIG. 3), to form an endless loop 70 (FIG. 4). Opposite sides of the loop are pressed together into abutting or contiguous relation, as illustrated in FIG. 5, and the pair of resilient sleeves 86 are positioned on intermediate line portions 82 and 84 as illustrated in FIG. 6. The terminal bowstring receiving loops 73, 74 are then forwardly folded relative to the central line portions 78, 80 to the positions illustrated in FIG. 7**.

The release aid member 22 is then mounted on the bowstring 12, which is temporarily decoupled from the bow 17, by successively passing or threading the bowstring 12 through the loopholes 75 and 76 of end loops 73 and 74 respectively (FIG. 7). The resilient sleeves 86 permit relative movement of the line portions 82, 84 to facilitate temporary expansion of bowstring receiving loopholes 75, 76 during the threading operation. The release aid 22 is moved along the length of the bowstring 12 to a position (illustrated in FIG. 2) in generally parallel planes adjacent the arrow nocks 14 and the bowstring 12 is recoupled to the bow. Final relative adjustments of end loops 73, 74 can be made to tune the bow.

The central line portion 78 of line section 71 is then moved from a position out of the plane 65 of line section 71 to a position on the opposite side of the plane 67 of the other central line section 80. The central line portion 78 is thence moved rearwardly to form the draw pin receiving loop or eyelet 90 (FIG. 8).

The draw pin 50, sear block 26, and trigger 38 are moved to the draw positions illustrated in FIG. 1, and the enlarged buttonhead 54 of draw pin 50 is then inserted into the draw pin receiving eyelet opening 92. The resilient sleeves 86 permit slight expansion of the opening 92 to permit the head 54 to pass therethrough to the position illustrated in FIG. 1. The resilient members 86 will then contract and urge the intermediate line portions 82, 84 toward each other to move central line portions 78, 80 toward each other and again close the opening 92 so that the eyelet 90 tightly grips the neck 56 of draw pin 50.

The archer can thus carry the bow with one hand and the trigger-actuated apparatus 22 will unassistedly remain coupled to the bowstring in proper longitudinal position, along the length of bowstring 12, for draw. When the archer desires to shoot, he will then manually grasp and move the hand-held handle 32 rearwardly to move or draw the bowstring 12 from the position illustrated in FIG. 2 to the position illustrated in FIG. 9. As bowstring draw force is exerted by the draw pin 50 on the central line portion 78 to draw the bowstring 12, the line 71, including central line section 78, will move rearwardly relative to the line 72, including central line portion 80, against the biasing force of the then expanded diameter sleeves 86. The opening 92 will thus increase in size, and expand, as the sleeves 86 permit relative movement of the intermediate portions 82 and 84. The opening 92*a*, in the drawn position illustrated in FIG. 9, is of a substantially greater size than the normal predetermined size of draw pin receiving opening 92 illustrated in FIG. 8.

The draw force exerted on central line portion 78 will be transmitted by intermediate line portions 82, 84 to the end loops 73, 74 tending to close the size of loopholes 75, 76 and force the end loops 73, 74 to more tightly grip the bowstring 12. This will prevent relative rotation of the bowstring 12 and the release aid 22 and thus insure that the peep sight 13 is properly aligned for shooting.

The archer will then thumb actuate the trigger 38 counterclockwisely in the direction of the arrow 44. This will force the sear block 26 clockwisely, from the position illustrated to solid lines in FIG. 1, in the direction of the arrow 46, to allow the draw pin 50 to pivot from the position illustrated in solid lines in FIG. 1 to the release position illustrated in chain lines in FIG. 1. As the draw pin 50 moves from the draw position illustrated in solid lines in FIG. 1 to the release position illustrated in chain lines in FIG. 1, the draw pin head 54 will easily escape through the enlarged opening 92*a* to release the string 12 and thus propel the arrow 18 forwardly.

After the draw pin 50 is decoupled from the draw pin eyelet 90, the resilient sleeves 86 will contract and return to the positions illustrated in FIG. 7, and the release aid 22 will remain coupled to the drawstring 12 to dampen string vibration.

It is to be understood that the drawings and descriptive matter are in all cases to be interpreted as merely illustrative to the principles of the invention, rather than as limiting the same in any way, since it is contemplated that various changes may be made in various elements to achieve like results without departing from the spirit of the invention or the scope of the appended claims.

What is claimed is:

1. Apparatus for aiding the drawing and releasing of a bowstring for movement from a rest position in which the bowstring is substantially linear to a drawn position in which the bowstring is non-linear, to propel an arrow received by the bowstring, comprising:

an endless length of flexible material including a pair of lines coupled at their opposite ends by a pair of integral, bowstring-receiving loops;

each line including a central portion and a pair of intermediate portions integrally joining said end loops and the respective central portions;

one of said central portions being laterally movable relative to the other of said central portions to collectively define a closed draw loop, defining a draw loop opening which is normally of a predetermined size, for receiving a bowstring draw member;

said pair of intermediate portions of each line including first and second intermediate line portions disposed adjacent first and second line portions respectively of the other line;

yieldable means normally maintaining said adjacent intermediate portions of said pair of lines in contiguous positions in contiguous relation but permitting relative lateral movement of said adjacent intermediate portions coupled to said one central portion relative to said intermediate portions coupled to the other of said central portions to operative positions when draw force is exerted on said one central draw portion, to provide said draw loop with a draw opening of greater predetermined size.

2. The apparatus set forth in claim 1 wherein said yieldable means includes means for returning said first and second intermediate portions coupled to said one central portion from said operative position to said contiguous positions to reduce the size of said draw loop from said greater predetermined size to said predetermined size when said draw force is removed from said draw loop and said bowstring returns to said rest position.

3. The apparatus set forth in claim 2 wherein said yieldable means comprises expansible and contractible means operative to expand as said draw force is exerted on said one central portion and to contract when said draw force is removed.

4. The apparatus set forth in claim 3 wherein said yieldable means comprises a pair of expansible and contractible sleeves encasing said interjacent portions.

5. The apparatus set forth in claim 4 wherein the internal diameter of said sleeves is normally less than the outside diameter of said bowstring receiving loops.

6. The apparatus set forth in claim 5 wherein at least a part of said intermediate portion of one line is on one side of the plane of said central portion of the other line, and said central portion of said one line is on the opposite side of the plane of said central portion of said other line.

7. The apparatus set forth in claim 6 wherein said length of flexible material comprises a length of flaccid material.

8. The apparatus set forth in claim 7 wherein said length of flaccid material comprises a length of rope.

9. The apparatus set forth in claim 7 wherein said flaccid material is operative to transmit force exerted on said one intermediate portion to said bowstring receiving loops to urge said bowstring receiving loops to close toward said bowstring when said bowstring is in said drawn position.

10. Apparatus for aiding the drawing and releasing of a bowstring for movement from a rest position in which the bowstring is substantially linear to a drawn position in which the bowstring is non-linear, to propel an arrow received by the bowstring, comprising:

an endless length of flexible material including a pair of lines coupled at their opposite ends by a pair of integral, bowstring-receiving loops;

each line including a central portion and a pair of intermediate portions integrally joining said end loops and the respective central portions;

one of said central portions being laterally movable relative to the other of said central portions to collectively define a closed draw loop for receiving a bowstring draw member; and a release device, comprising a handle member adapted to be gripped by a human hand;

holding and release means mounted on said handle member including a draw pin receivable in said draw opening;

means pivotally mounting said draw pin for movement between a holding position received by said draw opening and a release position withdrawn from said opening;

movement interrupting means, movable between a blocking position in the path of a portion of said draw pin and a removed position to said blocking position;

means normally urging said interrupting means to said blocking position;

trigger means movable from a remote position to a releasing position to move said movement interrupting means to said removed position to permit said draw pin to be moved to said release position;

said draw pin including a loop receiving portion of predetermined cross-sectional area for receiving said draw loop, and a terminal enlarged head portion having a greater predetermined cross-sectional area which is greater than the cross-sectional area of said predetermined size opening.

11. The apparatus set forth in claim 10 wherein said end loops define bowstring receiving loopholes which lie in longitudinally spaced planes generally perpendicular to the plane of the draw loop opening.

12. An archery bowstring release aid, comprising:

an endless flaccid cord including a pair of adjacent lines having opposite end, and a pair of forward end loops, integrally coupling the adjacent ends of said lines, and providing bowstring receiving loopholes;

each of said lines including a central portion disposed between said opposite ends, and a pair of intermediate portions, intermediate with said central portion and said end loops;

one of said central portions being rearwardly displacable relative to the other of said intermediate portions to provide a draw loop defining a draw loop opening of predetermined size; and expansible and contractible means mounted on said intermediate portions urging said intermediate portions of said pair of lines to positions contiguous with each other but permitting rearward movement of said intermediate portions, coupled to said one central portion, relative to the other of said intermediate portions, coupled to said other central portion, such that the size of said draw loop can be increased to a greater predetermined size when rearward draw force is exerted on said one central portion.

13. Apparatus for aiding the drawing and releasing of a bowstring to propel an arrow, comprising:

bowstring draw means, adapted to be hand held, for movement between a bowstring draw position and a rest position, including a draw pin;

means mounting the draw pin for movement between a first position and a second position; and means for selectively holding said draw pin in said first position and for selectively releasing said draw pin to permit said draw pin to move to said second position;

means for coupling said draw pin to a bowstring, comprising flexible means, having a draw pin receiving aperture therein of a normal predetermined cross-sectional area, including expansible and contractible means permitting said draw pin receiving aperture therein to expand to a greater predetermined cross-sectional area when said draw means is in said draw position such that said draw pin can escape said aperture as said draw pin moves from said first position to said second position; said expansible and contractible means being operative to contract said draw pin receiving aperture to said predetermined cross-sectional area when said draw pin is withdrawn; and additional flexible means for mounting said first mentioned flexible means on a bowstring.

14. Bowstring release aid apparatus, comprising:

an endless flexible band, comprising central line portions including a bowstring draw pin receiving loophole;

a pair of end loops including bowstring receiving loopholes for receiving a bowstring; and intermediate line portions coupling said central line portions to said end loops; and expansible and contractible means on said intermediate line portions normally urging said intermediate line portions and said central line portions to positions in which said draw pin receiving loophole is a predetermined size but permitting movement of said intermediate line portions and said central portions to positions in which said draw pin receiving opening is of a greater predetermined size.

15. The apparatus set forth in claim 14 wherein said expansible and contractible means comprises a pair of resilient sleeves.

16. Bowstring release aid apparatus, comprising:

an endless flexible band, including first and second adjacent lines; and a pair of end loops, including bowstring receiving loopholes, integrally coupling the lines;

said first and second lines including a central line portion between the loops; and first and second intermediate line portions coupling the central portion to the end loops;

said central line portions being relatively laterally displaceable to provide a draw pin receiving opening of a normal predetermined size for receiving a bowstring draw pin; and expansible and contractible means mounted on said intermediate line portions yieldably urging said first and second intermediate line portions of said first line into abutting relation with said first and second intermediate line portions, respectively, of said second line but permitting movement of said first intermediate line portions relative to each other and movement of said second intermediate line portions relative to each other such that one of said central line portions can be moved relative to the other of said central line portions to increase the size of said draw pin receiving opening to a greater predetermined size.

17. Apparatus for aiding the draw and release of a bowstring, including:

a support body including a handle member adapted to be gripped by a human hand;

a draw pin swingably mounted on said body for movement between a bowstring draw position and a bowstring releasing position;

latch means moveable on said body between a latch position holding said draw pin in said draw position and an unlatching position permitting said draw pin to move to said releasing position; and trigger means moveably mounted on said body for permitting said latch means to move between said latching and unlatching extending positions;

said draw pin including an enlarged diameter terminal head extending uniformly, perimetrically about said draw pin.

18. Apparatus for releasably coupling a bowstring draw pin to a bowstring, comprising:

flexible draw means for drawing a bowstring;

said draw means having a draw pin receiving aperture of normal predetermined size therein; and expansible and contractible means for normally urging said draw means to a position in which said aperture is of said predetermined size but expansible to allow said draw pin aperture to increase in size; and means for mounting said flexible draw means on a bowstring including first and second longitudinally spaced flexible portions for receiving a bowstring.

19. The apparatus set forth in claim 18 wherein the position of each of said flexible portions can be adjusted along the length of a bowstring relative to the other of said first and second flexible portions when draw force is not exerted on said draw means.

20. The apparatus set forth in claim 18 wherein said expansible and contractible means comprises a pair of spaced apart resilient cylindrical members.

21. The apparatus set forth in claim 18 wherein said first and second longitudinally spaced flexible portions comprises first and second flexible longitudinally spaced loop portions, each of which is movable along the length of a bowstring relative to the other of said first and second flexible loop portions when draw force is not exerted on said draw means and operative, to tightly grip a bowstring when draw force is exerted on said draw means to inhibit movement of said loop portions relative to each other.

22. The apparatus set forth in claim 21 wherein said flexible means comprises a flaccid line.

23. Apparatus for releasably coupling a bowstring draw pin having a neck portion and an enlarged terminal head portion to a bowstring, comprising:

a flexible line including first line portions defining a draw pin receiving aperture for receiving a draw pin, and second line portions for mounting on a bowstring; and expansible and contractible means mounted on said line normally urging said first line portions to positions in which said aperture is of a predetermined size but permitting movement of said first line portions to second positions in which said aperture is larger than said predetermined size.

24. The apparatus set forth in claim 23 wherein said flexible line means includes third line portions between said first and second line portions and said expansible and contractible means comprises resilient cylindrical sleeve means snugly receiving said third line portions.

25. Apparatus for aiding the drawing and releasing of a bow-mounted bowstring to propel an arrow which is received by the bowstring, comprising:

a flexible release aid including draw means for drawing a bowstring including a portion defining an opening of predetermined size for receiving and gripping a draw pin when draw force is not exerted thereon, said draw means including expansible and contractible means for permitting said portion of said draw means to expand in response to draw force being exerted on said draw means to define an enlarged opening, larger than said predetermined size; and longitudinally spaced coupling means for coupling said draw means to longitudinally spaced portions of a bowstring to transmit draw forces from said draw means to longitudinally spaced portions of a bowstring and for retaining said draw means on a bowstring.

26. The apparatus set forth in claim 25 wherein said longitudinally spaced coupling means include flaccid coupling members defining bowstring receiving loopholes lying in generally parallel longitudinally spaced parallel planes which are generally perpendicular to the plane of said opening in said draw means.

27. The apparatus set forth in claim 25 wherein said draw means comprises a flaccid line member forming a draw pin receiving eyelet which defines said opening.

28. The apparatus set forth in claim 27 wherein said coupling means comprises flaccid line means including bowstring receiving loops coupled to said eyelet and defining longitudinally spaced string receiving openings for releasably receiving a bowstring.

29. The apparatus set forth in claim 28 wherein said expansible and contractable means comprises cylindrical, resilient sleeve means snugly receiving portions of said line member between said bowstring receiving loops.

30. Apparatus for aiding the drawing and releasing of a bowstring mounted on a bow for movement between a substantially linear rest position and a non-linear drawn position comprising:

a closed loop of flexible material having first and second adjacent lines integrally coupled together at their opposite ends by loops defining longitudinally spaced apertures for receiving a bowstring;

said lines including central line portions and intermediate line portions coupling said central line portions to said loops;

one of said central line portions being displacable to a laterally removed position relative to the other of said intermediate portions to define a draw opening of a normal predetermined size, and expansible and contractible means on said intermediate line portions for normally holding said intermediate line portions of said lines in contiguous relation but permitting relative lateral movement of said intermediate line portions such that said one central line portion can be moved laterally relative to the other of said central line portions and increase the size of said draw opening when draw force is exerted on said one intermediate line portion.

31. Apparatus for releasably coupling a bowstring draw pin to a bowstring to transmit bowstring draw forces from a bowstring draw pin to a bowstring and aid bowstring release comprising:

a flaccid line, including a pair of longitudinally spaced end loops having loopholes of predetermined size therein for snugly receiving a bowstring;

a draw pin receiving loop, coupled to said end loops, having a draw pin receiving opening therein of predetermined size for snugly receiving and gripping a draw pin when bowstring draw forces are not exerted on said loop; and expansible and contractible means on said line normally urging said line to a position such that said draw pin receiving opening is of said predetermined size but permitting relative movement of portions of said line to increase the draw pin receiving opening to a size greater than said predetermined size when bowstring draw force is exerted thereon;

said flaccid line including line portions integral with said end loops and said draw pin receiving loop operative to transmit draw forces from said draw pin receiving loop to said end loops, tending to reduce the size of said loopholes such that said end loops grip a bowstring received thereby with increased force.

* * * * *